United States Patent [19]

Eriksson

[11] 4,182,487

[45] Jan. 8, 1980

[54] APPARATUS HAVING A TEMPERATURE SENSITIVE ELEMENT FOR CONTROLLING A DAMPER IN A VENTILATION SYSTEM

[75] Inventor: Lennart O. R. Eriksson, Kalmar, Sweden

[73] Assignee: Teknoterm Systems AB, Malmo, Sweden

[21] Appl. No.: 861,706

[22] Filed: Dec. 19, 1977

Related U.S. Application Data

[63] Continuation-in-part of Ser. No. 687,612, May 18, 1976, abandoned.

[30] Foreign Application Priority Data

May 26, 1975 [SE] Sweden ..... 7505932

[51] Int. Cl.[2] ..... F24F 7/00; F24F 13/08

[52] U.S. Cl. ..... 236/49; 98/42 R; 98/66 R; 236/96; 98/32

[58] Field of Search ..... 236/49, 95, 96, 101 R; 98/42 R, 66 R, 19, 32, 40 C

[56] References Cited

U.S. PATENT DOCUMENTS

| | | | |
|---|---|---|---|
| 1,618,792 | 2/1927 | Wood et al. | 236/49 |
| 1,628,965 | 5/1927 | Giese | 236/49 |
| 2,477,619 | 8/1949 | Kennedy | 98/40 C |
| 2,584,305 | 2/1952 | Taylor | 236/49 |
| 2,869,450 | 1/1959 | Leigh | 98/40 C |
| 3,073,525 | 1/1963 | Cislo | 236/49 |
| 3,463,391 | 8/1969 | Haegens | 236/49 |
| 3,537,380 | 11/1970 | Spradling | 236/49 |
| 3,643,862 | 2/1972 | Byrne | 236/49 |

FOREIGN PATENT DOCUMENTS

| | | | |
|---|---|---|---|
| 458924 | 8/1949 | Canada | 236/49 |

*Primary Examiner*—Henry C. Yuen

*Attorney, Agent, or Firm*—Ostrolenk, Faber, Gerb & Soffen

[57] ABSTRACT

This invention relates to a ventilation system for buildings and comprises for use at a venting duct outlet (opening into the outdoor atmosphere or into a room) a movable duct closing means and a temperature sensing means which is connected to operate said duct closing means and is mounted to be exposed to effects of prevailing air temperature and wind conditions in the atmosphere outside the venting duct (outdoor temperature and wind force) as well as to indoor temperature and, as the case may be, indoor air flows to be actuated thereby and accordingly to operate the venting duct closing means, whereby the sensing means will operate so as to gradually close or open the venting duct closing means in dependence on the combined effects of outdoor wind force and outdoor and indoor temperature and, as the case may be, the rate of air flow of indoor temperature in the vicinity of the temperature sensing means.

13 Claims, 5 Drawing Figures

APPARATUS HAVING A TEMPERATURE SENSITIVE ELEMENT FOR CONTROLLING A DAMPER IN A VENTILATION SYSTEM

This application is a Continuation-in-Part of the copending application Ser. No. 687,612, filed May 18, 1976, now abandoned, which is relied upon and the entire disclosure and specification of which are hereby incorporated by reference.

This invention relates to an apparatus having a temperature sensitive element for automatically controlling a damper in a ventilation duct for buildings.

In residential buildings and other premises a not insignificant natural ventilation occurs by the penetration of outdoor air through cracks especially around windows and doors and by the exhaust of this air as draught through outgoing air ducts, usually from kitchens, water-closets and bathrooms. A very great percentage of the extant housing, int. al. practically all detached houses, have natural ventilation systems of this type.

When the outdoor temperature is low and in particular if a wind is blowing at the same time, natural ventilation will be strong and result in great heat losses, unless the outgoing air ducts have draught limiting devices for counteracting this increase in natural ventilation, which is unnecessary and uneconomical from the point of view of ventilation. It is certainly true that natural ventilation can be limited in winter by manual stepwise or complete shutting of the dampers, if any, in the individual rooms of the buildings, but this method is impractical and too coarse. It results in either too ample or too meagre a ventilation. The regulation of the dampers cannot become economically efficient unless it is continuously adapted int. al. to weather variations that may occur in the course of the day.

It is true that it has already been suggested to place in an outgoing air duct a temperature sensing means having a sensitive element which by changing its dimension or configuration at temperature variations in the ambient air gradually closes or opens a damper so that the amount of outgoing air can be controlled to some extent. It has also been suggested to place the temperature sensing means at the outlet of the outgoing air duct so that the temperature of the outdoor air will become a factor which may affect the dimensional or configurational conditions of the sensitive element and its ability to close and open a damper in the outlet.

It has proved, however, that these apparatuses for limiting the amount of outgoing air do not provide any actually energy-saving draught in the natural ventilation system. When the outdoor temperature is low and a wind is blowing much more air will be exchanged than at the same low temperature and in calm weather. In dwellings ventilated by natural draught the ventilation losses during the cold time of the year, i.e. heating season, are approximately one third of the total heat losses. It is therefore highly desirable to be able to limit the amount of outgoing air to the same extent as the wind increases. The prior art temperature sensing means in ventilation systems are temperature sensitive but do not simultaneously record outdoor air velocity changes.

In a cold day with a strong wind blowing the ventilation losses will therefore be unreasonably great in a conventional natural ventilation system even if some of the prior art temperature sensing and damper closing apparatuses are utilized in the outlet of the outgoing air duct.

It is highly desirable to be able to limit the ventilation in cold weather also for the reason that indoor air humidity would otherwise fall to unsanitarily low values. Present-day low air humidity in dwellings during the heating season is experienced by many people as inconvenient. The unusually great exchange of warm air by cold air highly contributes thereto. After being heated to room temperature the originally cold air will have an uncomfortably low relative humidity. The greater the change of air allowed in cold weather the drier the air in the house.

A third weather factor of importance apart from outdoor temperature and wind force, is the intensity of radiation. For instance at heavy solar radiation the indoor temperature will increase in spite of the cold outdoor temperature. It would then be suitable to increase the amount of outgoing air per unit of time. However, a prior art type of sensitive element in the outlet of the outgoing air duct, which mainly senses only the cold outdoor air, will not diminish natural draught limitation in the requisite degree, from which follows an uncomfortably high indoor temperature and poor ventilation.

At heavy thermal radiation, "cold radiation", for instance during a cold winter night, increased throttling and reduced ventilation are desirable.

Apparatuses capable of maintaining, automatically and by volume, the amounts of incoming air and outgoing air constant per unit of time, are of course conceivable. However, no apparatus of simple design and satisfactory function has hitherto been developed and proved specifically suited for the large number of extant houses with natural ventilation. The introduction of, for instance, considerably more expensive mechanical ventilation systems, possibly combined with heat recovery units, require much space and the houses into which such systems are installed, must be extremely well-insulated. The air movements necessarily produced by the mechanical ventilation imply highly increased risks for heavy leakage and great heat losses.

If the ventilation losses could be better restricted, particularly in very cold weather, it would be possible to make considerable gains in installation and energy production costs. It is a well-known fact that the installation and energy production units of a house must be dimensioned for but a few days per year that require specially great heat quantities. By restricting the very high ventilation losses during these days radically the installation and energy production units could be given small dimensions. This would imply lower installation costs for both individuals and society.

A general object of the present invention is to provide a simple mechanical apparatus which senses the temperature, wind force and possibly thermal radiation, "cold radiation", of outdoor air and which automatically limits the change of air in a house having natural ventilation to an economically and physiologically reasonable level irrespective of variations in these parameters.

The object of the invention is, particularly during the cold time of the year or the heating season, to keep the change of air on ventilation at an acceptable level with regard to both the temperature variations of the outdoor air and the prevailing wind conditions, and also at an acceptable level when solar radiation is intense and the indoor temperature rises, which is a particularly difficult problem in otherwise cold weather. More precisely, the object of the invention is automatically to control the amounts of air according to both insignificant and heavy variations of the outdoor climate, which means both outdoor temperature and wind force but also heat and cold radiation intensity so that a satisfactory as well as an economical ventilation can automatically be maintained also under highly varying circumstances.

It has now surprisingly been found that the object of the invention can be attained with the aid of a simple apparatus in a duct of a ventilation system. The apparatus according to the invention controls, as do prior art temperature sensitive air flow controlling devices to some extent, the flow of air in a duct of a ventilation system. The apparatus according to the invention comprises a damper in the duct, an operating means which is connected to the damper and can be for instance rotary or displaceable and in the form of a shaft, by means of which the damper can be gradually opened and closed, and a temperature sensitive element which is adapted heavily to expand or contract at small temperature changes and is fixedly arranged on the operating means of the damper in order to actuate the shaft in such a way as to realize gradual closing or opening of the damper by dimensional or configurational changes of the sensitive element at temperature variations.

Particularly characteristic of the apparatus according to the invention is that (1) the sensitive element is located outside the downstream end of the duct and exposed to the temperature prevailing outside the duct (outdoor or indoor temperature) and draught or wind conditions, and (2) the outlet duct has openings which deflect part of the air flowing through the duct towards the senstive element.

Where an outgoing air duct is concerned, the deflected part of warm outgoing air and, whenever applicable, prevailing cold wind thus simultaneously influence the senstive element but to a varying extent owing to the wind force and the temperature and velocity of the outgoing air. When a strong wind is blowing the temperature effect the wind exerts on the sensitive element will predominate, and when a weak wind is blowing the effect of the warm outgoing air. With strong, cold winds the damper is closed more than with weak winds of the same temperature since in the first case the part flow of warm outgoing air is not given the opportunity of heating the sensitive element so much as it is capable of doing in the second case. The result will thus be that the heat effect exerted by the warm outgoing air on the sensitive element decreases at increasing wind force and increases at decreasing wind force, and that the damper is gradually closed at increasing wind force and gradually opened at decreasing wind force, or gradually closed at decreasing outgoing air temperature and/or outdoor temperature and gradually opened at increasing outgoing air temperature and/or outdoor temperature.

Where an incoming air duct is concerned, the result will be that the incoming air flow increases with increasing outdoor wind force. The deflected part of the incoming air is led into contact with the sensitive element which is thus influenced by both the temperature of cold outdoor air and by wind force (wind velocity), but the sensitive element is also influenced by the movements of indoor air (the air in the premises). At increasing wind force outdoors the influence of incoming air increases (owing to increasing inflow of air into the incoming air duct) in relation to the part of the indoor air flow which also influences the sensitive element. With increasing wind force and decreasing outdoor temperature the sensitive element is ever more actuated for closing of the damper, but the temperature of the indoor air and the flow thereof into contact with the sensitive element acts in the opposite sense, that is, for opening of the damper, from which follows that the damper is set into a position which depends on both indoor temperature, outdoor temperature and wind force. As a result, the most economical aeration of a room is obtained also in this case. By means of an apparatus which permits presetting of a duct for leading warm indoor air into contact with the sensitive element and/or presetting of the operating range of the sensitive element, separate rooms can be adjusted in different ways so that different individual wishes are satisfied.

In a preferred embodiment of the apparatus according to the invention the sensitive element is a temperature sensitive bimetal strip in the shape of a single helix. For control of outgoing air the helix is arranged on the outer side of the outlet duct, and for control of incoming air on the inner side of the incoming air duct so that it is respectively exposed to wind and weather and actuated by indoor air flows and in both cases by a part flow deflected from the duct. Its one end is fixedly anchored to the wall of the duct and its other end to a shaft which turns a damper disk or like damper means disposed in the interior of the duct for limiting the outgoing air when the helix is turned by the action of outdoor air and indoor air, respectively, and the part flow of outgoing air and incoming air, respectively, through holes in the duct in the vicinity of the helix.

In another preferred embodiment of the apparatus according to the invention, specially suited for control of outgoing air, the sensitive element is a temperature sensitive bimetal strip in the form of a single helix of small diameter, which in turn is shaped into a coil of large diameter so that a double-helix sensitive element is obtained. This bimetal construction is of heavily varying dimensions in the axial sense, which can be exploited in order, at falling temperature, to displace a shaft with a damper so that the damper is gradually closed. The double helix itself can also function as a shaft, which gives a very simple construction. In that case, the sensitive element and the control means are united in one and the same movable detail. The double helix should suitably be placed in vertical position in a housing which is formed with wind openings and in which the double helix can slide vertically as its dimensions vary, while the housing should be placed coaxially on the vertically directed outlet of the outgoing air duct so that the double helix can open and close a damper connected therewith and coaxially arranged in the duct. A part flow of the warm outgoing air is conducted through this housing of the bimetal element while the rest of the outgoing air flows away around the housing. At increasing wind force the part flow of warm outgoing air will have the opportunity to a diminishing extent of keeping the double helix at a temperature deviating from that of the outdoor air, which results in a gradual expansion or contraction of the double helix depending upon how the helical shape of the bimetal strip has been realized, and in gradual closure of the damper if the outdoor air is cold.

In a further embodiment of the apparatus according to the invention the sensitive element comprises a stack of washer-shaped bimetal elements. At rather insignificant variations of temperature the stack of bimetal elements will undergo heavy length variations in its axial direction and pulls or pushes a coaxial shaft so that a damper fixedly connected thereto in the outlet duct gradually closes when the wind increases and/or the temperature of the outdoor air falls.

In a preferred embodiment of the invention for outdoor location the housing of the bimetal element may be combined with a top wall member for the vertical outlet duct. Said top wall member covers the outlet of the entire outgoing air duct, can be horizontal or sloping and should protrude over the edges of the duct outlet so that the outgoing air will be caused to flow substantially horizontally out of the outlet duct. Such a further improvement of the apparatus according to the invention results in an increased capability of the apparatus to control the amount of outgoing air. With the aid of a sloping outlet top wall member a correction can be made for heat radiation and "cold radiation", respectively. However, such a correction can also be realized by the use of a suitable radiation absorbing/emitting sheet material or by a suitable surface treatment of the top wall member for the same purpose. The part of the wind that possibly penetrates beneath the top wall member of the duct and flows together with the part flows of outgoing air upwardly in the bimetal housing, is heated and therefore does not cool the bimetal element to the same extent as does a non-heated air quantity, or is cooled and therefore cools the bimetal element in a greater degree than wind that has not been cooled. An improved effect is thus obtained in cold windy and overcast weather as well as in warm sunny and windy weather. The "cold radiation" towards the top wall member cools the warm outgoing air flow and said flow will have a lower temperature effect on the bimetal element than an outgoing air controlling apparatus without any top wall member. The colder the weather, the greater the intensified effect resulting from the reverse radiation ("cold radiation") which is obtained by the described top wall member since natural ventilation has a tendency of growing exponentially as the outdoor temperature falls and since the combined effect of outgoing air and incoming air on the bimetal element is advantageous for draught control.

In an apparatus of the invention for control of incoming air the bimetal housing is located at the inner end of an incoming air duct, and in a preferred embodiment on the inner side of an inlet duct arranged in an outer wall in conjunction with a window. The inlet duct can be embodied in the form of a horizontal slot in the window structure or in the outer wall in close connection with the window. Such ducts are often to be found beneath the window sill in residential buildings and are usually provided with a manually adjustable damper. This damper is thus readily exchangeable for a bimetal operated damper according to the invention. The bimetal element and the damper can be built into a compact elongated apparatus housing with an inlet connected to the slot and an inlet connected to the room inside the outer wall, a shunt conduit being branched off from the passage between the inlet and outlet of the compact apparatus housing and extending through a chamber in which the bimetal element is disposed, said shunt conduit opening into said room via openings in the wall of the bimetal chamber. The bimetal element is connected to a valve closure member in the form of a flap which controls the flow through the main passage in the apparatus housing, that is, the flow between the slot in the outer wall and the inlet of the apparatus leading to the room inside the outer wall.

Embodiments of the invention will be described in more detail hereinbelow with reference to the accompanying drawings for illustration of the above features as well as further features of the invention.

Figure 1:
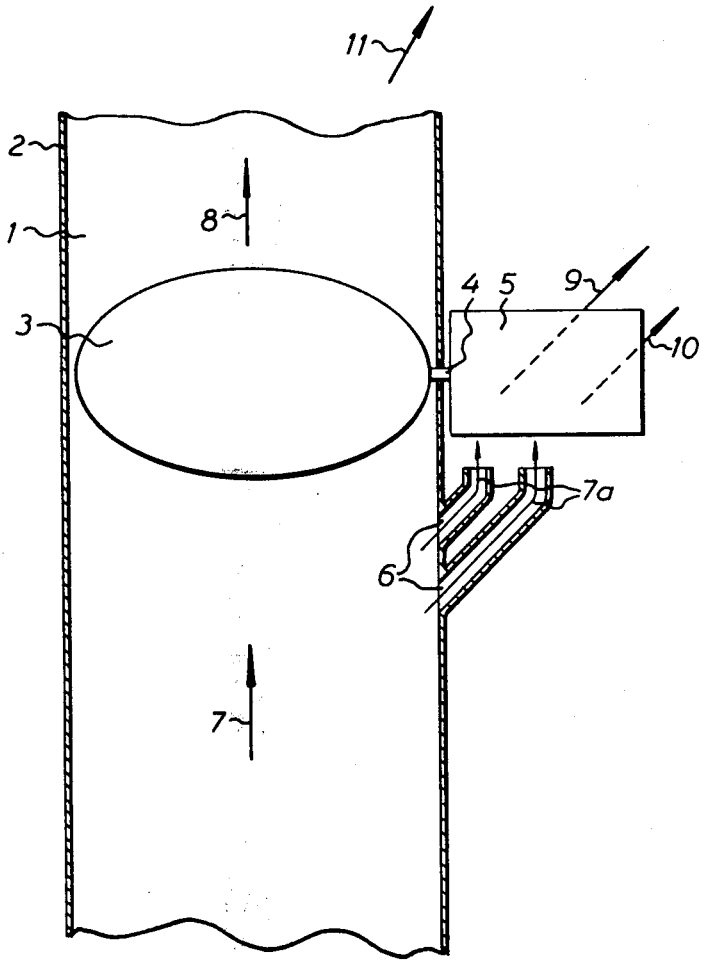
FIG. 1 is a schematic view illustrating the function of a ventilation limiting apparatus.

FIG. 1 illustrates a natural ventilation system in which the apparatus according to the invention is installed in the outgoing air duct 1 of the system, the outlet end of said duct being designated 2 and a damper 3 being provided near the outlet end of the duct. A temperature sensitive element 5 is arranged on the outer side of the duct 1 outside the damper 3, thus at or in the vicinity of the outlet end 2. The sensitive element 5 is adapted to operate the damper via a shaft 4 connected thereto by rotary or optionally shifting movement in dependence on temperature changes acting upon the element 5. The damper is thus adjustable in the duct 1 for regulating the flow of outgoing air into ambient air. The sensitive element 5 shall thus be adapted to operate the damper 3 for reduction of the cross-sectional area of the duct 1 when the temperature falls, and vice versa.

The outgoing air 7 flows towards the damper 3 in the duct 1 but before it reaches the damper 3 one or more part flows *7a* are deflected from the main flow 7 through one or more openings 6 to actuate the sensitive element 5 thermally. Of the main flow 7 there only remains the flow 8 which is led into ambient air at the outlet end 2. The wind factor is represented by the arrow 9. The stronger the wind, the more rapidly will the outgoing air flow 8 escape as a flow 11 in the wind direction. In windy weather the warm part flows *7a* are also affected. The sensitive element 5 is thus exposed both to wind and weather and to the part flow or flows *7a*. The stronger the wind, the lesser possibility have the part flows *7a* of heating the sensitive element 5. The part flow or flows then do not reach the sensitive element to the same extent as in calm weather but are mixed by wind actuation with the outdoor air and are more or less deflected, from which results a lesser actuation of the sensitive element. The arrow 10 represents some of the outgoing part flow. This implies that the stronger the wind in cold weather, the colder the sensitive element 5, and the more will the sensitive element 5 turn or push the damper 3 (via the shaft 4) so that the damper 3 is adjusted to such positions that the outgoing air will be given a limited possibility of flowing through the outgoing air duct 1. The tendency of an increase of the outgoing air flow 7, 8, 11 at increasing wind force in cold weather and the resulting poor heat economy of the natural ventilation system are thus corrected or reduced automatically by the apparatus according to the invention.

In a preferred embodiment of the apparatus the sensitive element 5 is a temperature sensitive bimetal strip shaped into a single helix. The helix is arranged at the outer wall of the outlet duct 1 and is exposed to wind and weather. One end thereof is fixedly anchored to the wall of the duct and the other end to a rotatably mounted shaft 4. A rotary damper in the duct 1 is operated via said shaft 4 in dependence on the twist of the helix by the action of outdoor air 9 and the part flow 7*a* of outgoing air which exits in the vicinity of the helix through the duct openings 6.

Figure 2:
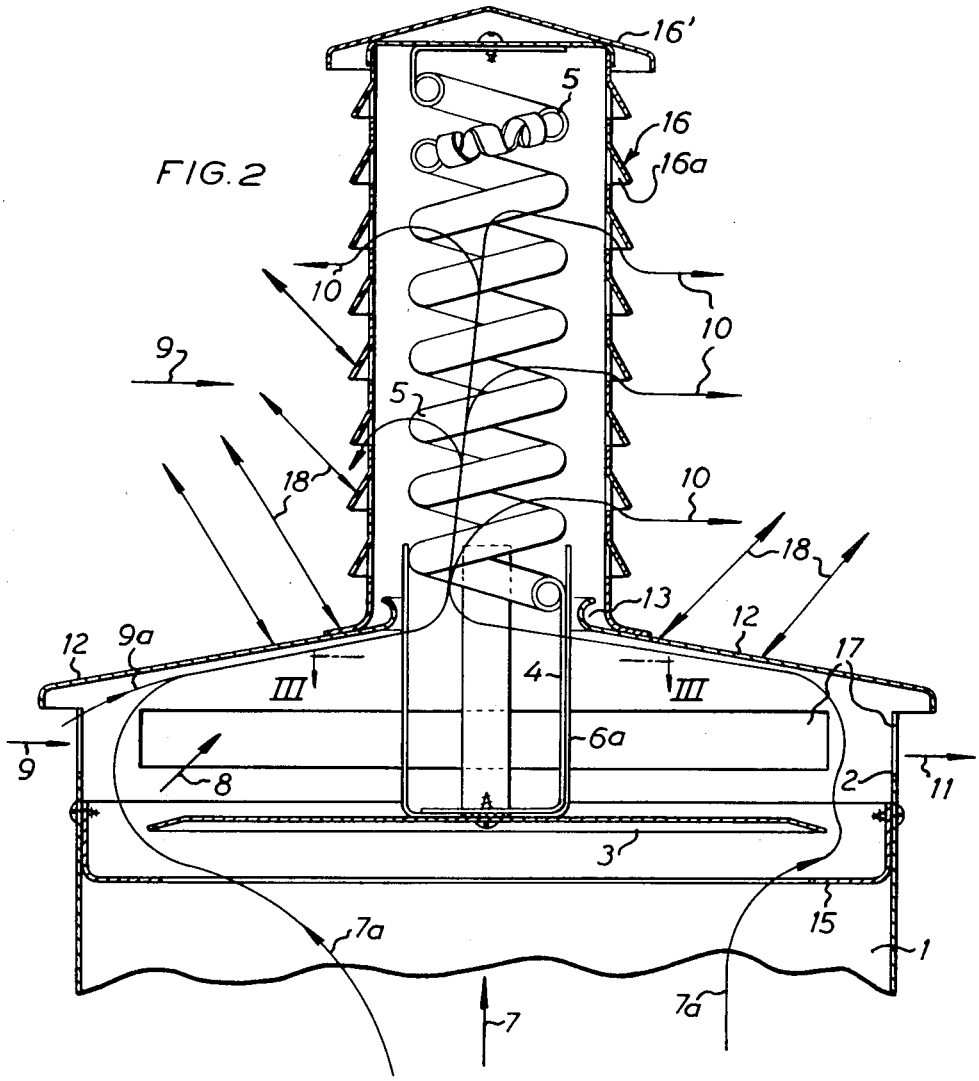
FIG. 2 is an axial section of a particularly preferred embodiment of an outgoing air limiting apparatus, which includes a temperature sensitive element in the form of a double helix bimetal strip in a housing at the outlet end of the outgoing air duct.
Figure 3:
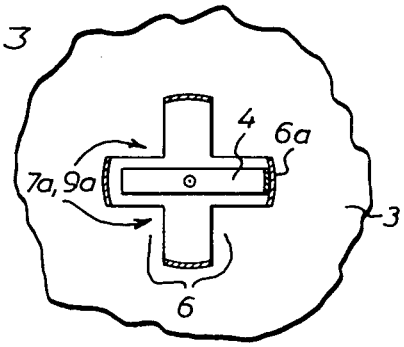
FIG. 3 is a fragmentary cross-sectional view taken on the line III—III in FIG. 2.

FIGS. 2 and 3 show a specifically preferred embodiment of the invention, which can be influenced also by heat radiation and cold radiation. This apparatus includes a temperature sensitive element 5 in the form of a double helix. The double helix 5 is made from a bimetal strip by first forming the strip into a single helix of small diameter and then forming the small diameter helix into a single helix of large diameter, for which reason the term "double helix" for the element 5 is fully adequate. To wind bimetal strips into such double helices is previously known. Depending upon the manner in which the double helix is wound it will expand or alternatively contract when heated. The embodiment illustrated in FIG. 2 operates on the lastmentioned principle, which means that the double helix 5 when cooled moves the damper 3 downwards in FIG. 2, and in its fully closed position the damper could bear against a sealing edge 15.

With the use of a double helix made according to the firstmentioned alternative, that is, of opposite movement with regard to the case illustrated, the sealing edge 15 shall be placed above the damper 3 so that the latter upon closure approaches said sealing edge.

If desired, the sealing edge 15 can be movable so that it can be set into a position that some ventilation is obtained through the duct also at fully closed damper. The sealing edge can also be arranged in another manner for attaining this result. At severe cold or when a strong cold wind is blowing the ventilation in normally insulated residential buildings is adequate through the extant leaks, for which reason the damper 3 can be fully closed in these circumstances.

The double helix is placed in a housing 16 at the outlet end of the duct 1, which is formed with several ventilation openings 16*a*. The helix has its upper end fixed to the roof 16' of the housing 16 and its lower L-shaped end portion (which forms a motion transmitting member 4) connected to the damper 3. The double helix thus in an integral piece forms both the temperature sensitive element 5 and the damper operating means 4. A guide sleeve 6*a* formed with slots or openings 6 is secured to the damper 3 at the point of fixation of the damper to the end portion 4 of the element 5. Said guide sleeve is arranged to slide in a guide 13 in a disk-shaped element 12 which is disposed as a roof over the outlet of the duct 1 and is fixed to the duct, forming a supporting means for the housing 16 in which the bimetal helix 5 is placed.

Warm outgoing air 7 flows towards the outlet end 2 of the outgoing air duct 1. The amount of outgoing air 7 is determined by the gap between the damper 3 and the sealing edge 15. Part of the warm outgoing air 7 is deflected in the form of part flows 7*a* through the openings 6 of the guide sleeve 6*a* (cf. FIG. 3) and in an upward direction in the housing 16 and there yields a heat addition which together with the outdoor air in the housing imparts to the bimetal helix 5 a certain temperature and resulting length expansion and to the damper 3 associated with the bimetal helix 5 a definite position in relation to the sealing edge 15.

A certain temperature condition in the housing 16 results in a definite gap between the damper 3 and the sealing edge 15. The major portion of the outgoing air flow 7 escapes as outgoing air flows 8 through this gap and through the main ventilation openings 17 spaced around the outlet end 2 of the duct 1. The part flows 7*a* successively escape as part flows 10 through the ventilation openings 16*a* of the housing 16.

By wind influence and by the successive increase of the wind 9 from zero there arise successively changing flow conditions, there conditions being exemplified hereinbelow by three phases designated A, B and C. Each of said phases gives an increased and intensified cooling of the bimetal element 5 with resulting ever more decreasing flow of outgoing air.

A. The more the wind increases from zero the lesser possibility have the part flows 7*a* of outgoing air to deliver their heat addition to the bimetal element 5 since said part flows escape ever more early and rapidly as part flows 10 in the direction of the wind 9.

B. At a wind force of certain strength some part flows 9*a* of outdoor air besides penetrate through the main ventilation openings 17 and mix with the part flows 7*a* of outgoing air, and depending upon the wind force, said part flows 9*a* wholly or partly pass together upwardly through the housing 16 in the same way as the earlier part flows 7*a* of outgoing air alone, in order to actuate the bimetal element 5 therein. By the admixture of the cool part flows 9*a* of outdoor air in this manner the heat actuation of the bimetal element 5 will be even somewhat lower and as a consequence the flow of outgoing air will be reduced as compared to that prevailing in calm weather and in case A above.

C. According as the wind force increases the majority of the warm part flows 7*a* of outgoing air disappear in ever earlier stages. With very strong winds no warm part flows 7*a* of outgoing air at all reach the bimetal element 5 but blow away in the direction of the wind 9, escaping directly into ambient air as a flow 11. The result is that the stronger the wind the bimetal element 5 is cooled to an ever increasing extent and that as a consequence the outflow of outgoing air will be successively reduced, this being the aim contemplated.

The third weather factor, radiation, influences the apparatus according to the invention in the following manner.

The influence of radiation may be considered as an intensifying effect which is superimposed on earlier temperature and wind influences. The radiation (represented by arrows 18) is directed respectively towards the top wall member 12 and the housing 16 upon influence of solar radiation, and from the top wall member upon influence of "cold radiation", i.e., heat radiation from the top wall member, particularly against a dark sky. The top wall member 12 above the duct 1 and the housing 16 are of such a material and/or so surface-treated as to be heavily radiation-absorbing or heavily radiation-emitting.

Upon incidence of solar radiation 18 towards the radiation-absorbing top wall member 12 the part flows 7*a* of outgoing air and possibly the part flows 9*a* of outdoor air will receive a heat addition when they pass beneath the slightly sloping top wall member 12 on their way up in the housing 16. This implies a larger heat actuation of the bimetal element 5 with an ensuing increase of flow of outgoing air. Since the housing 16 also is radiation-absorbing this will entail an additional heating of the bimetal element 5 directly and as a function of the intensity of solar radiation. That the amount of outgoing air per unit of time thus increases with the intensity of the solar radiation 18 is desirable from the viewpoint of ventilation and can be allowed also at a relatively low outdoor temperature, since the room temperature would otherwise be uncomfortably high because of the solar radiation energy absorbed by the building, primarily directly through the windows. The heat amounts absorbed and stored in the walls etc. of the building, which later, in hours of unintensive sun, emit a desired heat addition are not affected by the embodiment of the invention comprising a bimetal element in the form of a double helix. The night following upon a clear sunny day is often clear and cool with intensive "cold radiation" whereby the double helix will be heavily cooled in a corresponding degree since the top wall member 12 and the housing 16 also are heavily radiation-emitting.

An excess temperature, if any, which has arisen for various reasons in the building implies an increase of the outgoing air flow and temperature as well as higher temperatures of the part flows *7a* of outgoing air, which will thus be capable of heating the double helix 5 in a higher degree, entailing a desired increase of ventilation.

In a further embodiment of the apparatus according to the invention the sensitive element 5 comprises a stack of washer-shaped bimetal elements (not shown). Said stack heavily varies in axial length at rather insignificant temperature variations and is adapted to operate a damper or like means in the duct 1 on the same principle as that described with reference to FIGS. 2 and 3.

Some further positive effects and system alternatives will now be described.

A thorough sealing of such ordinary paths of heat leakage in buildings as are formed for instance by cracks around windows and doors, is not a sufficient measure to prevent heat losses by natural draught. If the most usual paths of heat leakage are sealed the draught may increase through other leakage paths, and for an efficient saving of energy a satisfactory sealing should be supplemented with a positive control of the ventilation systems in conformity with the invention. A well-sealed building equipped with means for natural ventilation and an automatically operating control apparatus according to the invention will provide an optimum economical result as the control takes place with due regard to all important factors, such as indoor temperature, outdoor temperature, wind force and radiation conditions and as the apparatus according to the invention is inexpensive and can be incorporated without any great costs in ordinary natural ventilation systems.

The invention is applicable also to such prior art systems of mechanical ventilation as are designed for intermittent operation to prevent unnecessary heat losses. In those cases the mechanical ventilation can be caused to operate only during the periods when considerable ventilation is required. During the intervening periods of natural ventilation the apparatus according to the invention can be utilized also in such a mechanical system. During the forced ventilation periods when the ventilators of the mechanical system are in operation the heavy air flow will cause the apparatus according to the invention to open fully. Said apparatus thus automatically adapts itself to the operation of the ventilators of the mechanical system and opens the ventilation duct, and then, that is, during the standstill periods of the ventilators, it controls the ventilation duct in the manner described.

Figure 4:
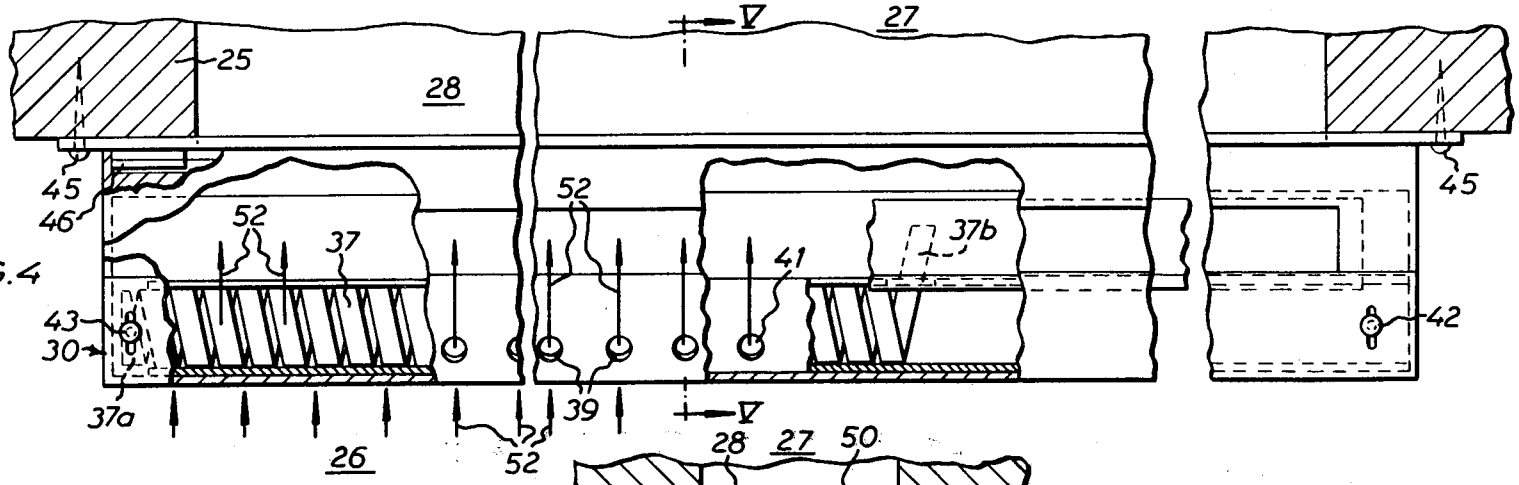
FIG. 4 is a horizontal section and partial plan view of an incoming air controlling apparatus of the slide valve type.
Figure 5:
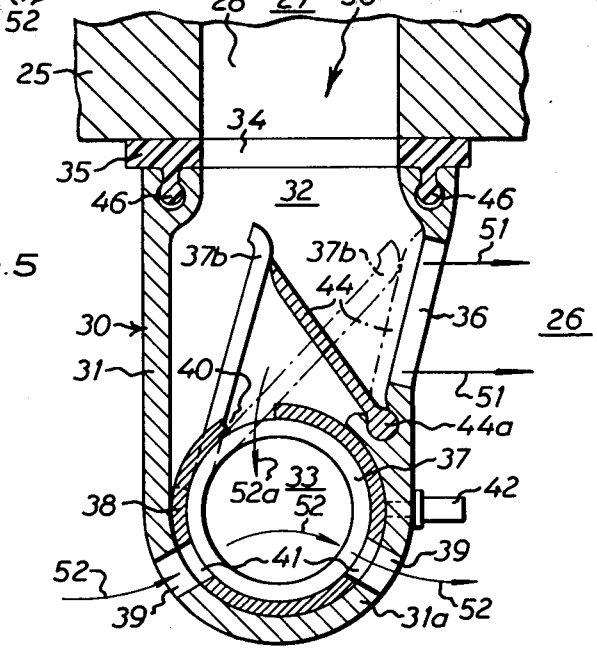
FIG. 5 is a cross-sectional view of the apparatus taken on the line V—V in FIG. 4.

FIGS. 4 and 5 show a preferred embodiment of the invention for control of incoming air.

25 designates an outer wall which separates a room 26 in a residential building from outdoor air at 27. A horizontal slot 28 is provided in the wall 25 of the window section (i.e. frame and casement), for example above or, as shown, below a window (not shown). The invention is here embodied in the form of a very compact apparatus which is generally designated 30 and includes an apparatus housing 31 with two chambers 32, 33. One chamber 32 is in the form of a passage which is of substantially the same length as the slot 28 and is connected, on the one hand, to the slot 28 via a slot 34 in a bottom plate 35 and, on the other hand, to the room 26 via an inlet slot 36.

The bimetal element 37 is in the form of a single helix and is located in the chamber 33 which is delimited from the chamber 32 by a rotary sleeve 38 mounted in an internally cylindrical part 31*a* of the apparatus housing 31. Said part 31*a* of the housing 31 has one or more apertures 39, and the sleeve 38 has an inlet slot or inlet apertures 40 as well as outlet slots or outlet apertures 41. The inlet slot 40 connects the main chamber or main passage 32 to the bimetal chamber or bimetal passage 33, and the apertures 41 are in communication with the apertures 39 and via them with the room 26.

The sleeve 38 is rotatable by means of a handle 42 accessible from the room 26 so that the free cross-sectional area of the apertures 39, 41 can be controlled.

One end 37*a* of the bimetal element 37 is connected to the apparatus housing 31, perferably via a device 43 which permits adjustment of the angular position of the bimetal element in the sleeve 38, while the other end of the bimetal element is connected to an operating arm 37*b* or constitutes said operating arm which is adapted to actuate a valve flap 44 shown in FIG. 5 by full lines in a fully open position and by dash and dot lines in a fully closed position relative to the inlet 36 of the incoming air passage 32.

In the illustrated design the valve flap 44 is secured in the apparatus housing in that an inner bead-shaped edge 44*a* of the flap 44 is fixed in a seat of circular section in the wall 31 of the apparatus housing. In this case, the flap 44 can be made from elastic material and arranged in such a way as to form an element which by its inherent elasticity tends to return from closed to open position, whereby it is constantly kept in engagement with the bimetal arm 37*b*. However, the flap 44 may instead be disposed with its edge bead 44*a* in said seat and can have such a weight or be connected to the bimetal arm 37*b* to be both opened and closed by its own weight or positively. Optionally, the flap 44 can be loaded towards open position by a spring (not shown).

The bottom plate 35 of the apparatus housing 31 is meant to be fixed on the wall 25 by means of for example screws 45 and in the embodiment illustrated has two parallel, inwardly directed ribs 46. Matching grooves are provided at the inner edges of the opposite side walls of the housing 31. With suitably shaped ribs 46 and matching grooves the housing 31 can be readily mounted on the bottom plate 35 by exertion of pressure on the housing for bringing about engagement between the housing 31 and the ribs 46 of the bottom plate. When the housing 31 is made from sheet metal, the bottom plate 35 can be of elastic material, for example plastic, which facilitates the above described mounting of the housing 31.

As a rule, the bimetal element 37 need not be of as great a length as the apparatus housing 31. In the illustrated embodiment the bimetal element 38 is approximately half the length of the housing 31 and the bimetal arm 37*b* acts substantially at a point midway between the ends of the valve flap 44.

In FIG. 5 the flow of incoming air from outside is indicated by arrows 50, and the indoor air flow in the room 26 by arrows 51. Part of the incoming air can flow through the chamber 33 as a part flow 52*a*, but warm air also can flow from the room 26 through the chamber 33 in the manner indicated by the arrows 52.

The air flows 50-51, 52, 52*a* fundamentally correspond to the air flows that may occur in the embodiment shown in FIGS. 1 and 2.

At increasing wind force outside the wall 25 the flows in the direction 50, 52*a* may dominate. These cold air flows act upon bimetal element 37 and cause the damper 36 to close depending upon air volume and air temperature. However, warm air also flows through the bimetal element 37 according to the arrows 52, and the bimetal element is thus actuated also in dependence on the temperature of the indoor air and the damper 44 is therefore adjusted in dependence on both the temperature of the indoor air (warm air) and the temperature and wind force of the outdoor air, whereby the control of incoming air takes both the outer and inner conditions into consideration.

By reason of the possibility to set the throughflows 39, 41 and the angular position (initial position) of the bimetal element 37 in the manner described, the apparatus 30 can readily be adapted to various aeration requirements.

The apparatus illustrated in FIGS. 4 and 5 is an example of an ingenious solution of the problem of applying the principle described with reference to FIGS. 1 to 3 to an incoming air duct instead of an outgoing air duct. The embodiment shown in FIGS. 4 and 5 owing to its simplicity and compact design is extremely advantageous and can be utilized instead of the conventional, usually manually adjustable slide valves employed in conjunction with apertures in outer walls beneath windows.

It is advantageous to use both automatically controlled incoming air dampers according to FIGS. 4 and 5 and automatically controlled outgoing air dampers according to FIGS. 1 to 3 to realize full selfcontrol of residential buildings and other houses. The automatic incoming air damper manages to control and limit the ventilation that arises straight through a house from the windward side to the lee side and that represents a large, earlier unchecked item of energy loss where uncontrolled slide valves are used. The invention is, however, also applicable to fan ventilation systems, which is readily realized by those skilled in the art without any particular description.

In a house having several controlled dampers according to the invention the dampers are closed to a higher extent on the windward side than on the lee side, whereby maximum aeration will always take place on the most favorable side of the house, which is an important advantage.

What I claim and desire to secure by Letters Patent is:

1. In residential buildings, apartment houses and the like equipped with a venting duct controllable by means of a movable duct closing means, the venting duct having an inlet side and having an outlet side, an apparatus for controlling the flow of air through the venting duct to the outlet side thereof, the apparatus comprising the movable duct closing means in the venting duct, a motion transmitting device for operating the duct closing means in the duct thereby for resulting control of the cross-sectional area of the duct, and a temperature sensitive element cooperating with the motion transmitting device and adapted to react to temperature changes and to thereby actuate in cooperation with the motion transmitting device the duct closing means in the venting duct in dependence on the actuation of the temperature sensitive element by the temperature, the temperature sensitive element being disposed at the outlet side of the venting duct so that it is exposed to the temperature and air flow conditions prevailing at the outlet side, and the venting duct having air flow shunting means for shunting part of the air flowing through the duct as a part flow into contact with the temperature sensitive element so that both said part flow and air of the temperature prevailing at the outlet side of the duct are allowed to actuate the temperature sensitive element, whereby the temperature of the temperature sensitive element is influenced by the part flow in a degree dependent on both the prevailing outdoor temperature and wind force and by the prevailing indoor temperature, whereby the motion transmitting device is thereby actuated such that it tends to open or close the duct closing means in dependence on a combination of at least the outdoor temperature, the outdoor wind force and the indoor temperature.

2. An apparatus as claimed in claim 1, wherein the air flow shunting means also comprises means for causing the temperature sensitive element to be actuated by indoor temperature in a degree dependent on indoor air flows.

3. An apparatus as claimed in claim 1, wherein the temperature sensitive element is a single helix of a bimetal strip for actuating the motion transmitting device to close or open the duct closing means in the venting duct gradually in dependence on varying wind and outdoor temperature conditions outside the venting duct.

4. An apparatus as claimed in claim 1, in which the inlet side of the duct is in communication with the outdoor atmosphere and the outlet side of the duct is in communication with a room of the building, the temperature sensitive element being disposed in a chamber which is in communication with the duct and with the room for shunting said part flow from the duct to the room via the chamber and into contact with the temperature sensitive element therein, and the chamber being disposed at the outlet side of the duct and in conjunction with the room as that the air temperature in the room is allowed to actuate the temperature sensitive element.

5. An apparatus as claimed in claim 1, comprising a housing having first and second chambers, said first chamber forming an air shunting chamber and housing said temperature sensitive element and said second chamber forming a venting chamber having an inlet means for communication with said duct and an outlet means, said housing having means for connecting said inlet means of said venting chamber to said duct to form an outlet portion on the latter with said outlet means of the venting chamber in communication with said room, said air shunting chamber having outlet means for communication with said room and being spaced from said venting chamber by a partition having at least one opening therein forming said air flow shunting means for shunting said part flow of incoming outdoor air from said venting duct via said outlet means of said shunting chamber to said room, said movable duct closing means being mounted movoable between relatively open and closed positions in relation to said outlet means said venting chamber, said temperature sensitive element in said air shunting chamber being operably connected to said movable duct closing means by said motion transmitting device for regulating the position of said movable duct closing means in said venting chamber and thereby controlling the throughflow of outdoor air from the outdoor side of the house into the inlet means venting chamber and into said room according to said combination of at least the outdoor temperature, the outdoor wind force and the air temperature in the room.

6. An apparatus as claimed in claim 5, wherein the first chamber is tubular and the temperature sensitive element disposed in the first chamber is a bimetal element in the form of a single helix of a bimetal strip having a diameter smaller than the inner diameter of the chamber to permit dilation of said temperature sensitive element therein.

7. An apparatus for controlling the flow of outgoing air in the venting duct of a ventilation system, said venting duct having an inlet and an outlet side, and said apparatus comprising a movable duct closing means in the venting duct, a motion transmitting device for operating the duct closing means in the duct and for controlling the effective through-flow area of the duct, and a temperature sensitive element which is adapted to react a small temperature changes and is connected with the motion transmitting device to gradually close or open via said device the duct closing means in the duct in dependence on the temperature reactions of the sensitive element, the temperature sensitive element is disposed at the outlet side of the venting duct and is exposed to the prevailing outdoor temperature and wind conditions, and the venting duct has at least one opening for deflecting a part flow of the outgoing air of indoor temperature into contact with the temperature sensitive element so that both said part flow of the outgoing air and wind of outdoor temperature are allowed to actuate the temperature sensitive element, whereby the relative actuation of the temperature sensitive element from the part flow of outgoing air decreases at increasing wind force and the temperature sensitive element by being actuated by outdoor wind of outdoor temperature and by said part of outgoing air of indoor temperature will thus operate so as to shift the motion device to gradually close the venting duct closing means at increasing wind force, gradually open the venting duct closing means at decreasing wind force, gradually close the venting duct closing means at increasing flow rate of outgoing air and decreasing outdoor temperature, and gradually open the venting duct closing means at increasing flow rate of outgoing air and increasing outdoor temperature and thereby operate to regulate said venting duct according to a combination of the factors comprising the outdoor wind force, the outdoor temperature, the flow rate of outgoing air and the temperature of the latter.

8. An apparatus as claimed in claim 7, wherein the temperature sensitive element is a single helix of a bimetal strip for actuating the motion transmitting device to close or open the duct closing means in the venting duct gradually in dependence on varying wind and outdoor temperature conditions outside the venting duct.

9. An apparatus as claimed in claim 7, wherein the temperature sensitive element is in the form of a double helix consisting of a bimetal strip formed as a single helix from which is formed a helical coil body, and said body is adapted to actuate the duct closing means for gradually closing the duct at increasing outdoor wind and falling outdoor temperature.

10. An apparatus as claimed in claim 7, wherein the temperature sensitive element is a stack of washer-shaped bimetal elements, said stack being adapted to push or pull a motion transmitting device coaxial with the stack so that the duct closing means in the venting duct is gradually closed at increasing outdoor and falling outdoor temperature.

11. An apparatus as claimed in claim 7, wherein said tubular member is rotatably mounted and angularly adjustable in said housing and wherein the effective throughflow area of said opening means in said facing wall portions of said tubular member and said housing is adjustable by angular adjustment of said tubular member.

12. An apparatus as claimed in claim 7, wherein said fixed end of said bimetal element is adjustably fixed in relation to said tubular member and having means connected thereto for adjusting the angular position of said bimetal element in said housing for presetting said motion transmitting means in relation to said valve means.

13. An apparatus for controlling the flow of ingoing air in a venting duct, comprising the venting duct having inlet and outlet ends, an elongated housing having a base and side walls, said side walls being supported at their one ends by said base and merging at their other ends into and being joined by a wall member having a substantially cylindrical inner peripheral surface, a tubular member mounted rotatably in said housing in contact with said inner peripheral surface of said wall member, said tubular member defining in said housing a first chamber, said housing comprising a second chamber between said base and said tubular member, said base having means forming an inlet means for said second chamber and means for connecting said housing to the outlet end of said venting duct with said inlet means in communication with said second chamber, said housing having in at least one of said side walls an outlet means spaced from said base and from said side tubular member, a valve means mounted in said second chamber movably between open and restricting positions in relation to said outlet means of said one side wall, a temperature sensitive bimetal element in the form of a substantially cylindrical helix of a bimetal strip, the cylindrical bimetal element having a diameter which is smaller than the inner diameter of said tubular member and being mounted for slidable and rotatable dilatational movement in said tubular member, said second chamber with its inlet and outlet means forming a valve controlled main flow passage for air from said venting duct to the outside of said housing, said tubular member and said housing having in facing wall portions thereof opening means which form a relatively restricted seconday air flow passage from said second chamber to the outside of said housing via said first chamber and in contact with said bimetal element housed in the latter, said bimetal element being fixed at one end for actuation of said valve member and controlling the flow of air from said venting duct through said valve controlled main flow passage in dependence on a combination of influents on said bimetal element from the temperature of air flowing through said secondary flow passage, the air flow rate from said venting duct into said housing and the temperature of the atmosphere surrounding said housing.

* * * * *